US007237605B2

(12) United States Patent
Ozaki

(10) Patent No.: US 7,237,605 B2
(45) Date of Patent: Jul. 3, 2007

(54) HEAT EXCHANGER

(75) Inventor: Tatsuo Ozaki, Okazaki (JP)

(73) Assignee: DENSO Corporation, Kariya (JP)

( * ) Notice: Subject to any disclaimer, the term of this patent is extended or adjusted under 35 U.S.C. 154(b) by 45 days.

(21) Appl. No.: 11/325,683

(22) Filed: Jan. 4, 2006

(65) Prior Publication Data

US 2006/0144579 A1 Jul. 6, 2006

(30) Foreign Application Priority Data

Jan. 6, 2005 (JP) ..... 2005-001921

(51) Int. Cl.
*F28F 9/02* (2006.01)

(52) U.S. Cl. ..... 165/173; 165/149

(58) Field of Classification Search ..... 165/148, 165/149, 151–153, 172, 173, 175, 81
See application file for complete search history.

(56) References Cited

U.S. PATENT DOCUMENTS 4,582,127 A * 4/1986 Moranne ..... 165/83
4,881,594 A * 11/1989 Beamer et al. ..... 165/83
5,492,172 A * 2/1996 Laveran et al. ..... 165/173
5,996,633 A * 12/1999 Kato ..... 138/38
6,305,465 B1 * 10/2001 Uchikawa et al. ..... 165/140
6,357,521 B1 * 3/2002 Sugimoto et al. ..... 165/173

FOREIGN PATENT DOCUMENTS

| | | |
|---|---|---|
| JP | 61-141593 | 9/1986 |
| JP | 61-141594 | 9/1986 |
| JP | 61-144393 | 9/1986 |
| JP | 4-92175 | 8/1992 |
| JP | 10-132485 | 5/1998 |

* cited by examiner

*Primary Examiner*—Teresa J. Walberg
(74) *Attorney, Agent, or Firm*—Harness, Dickey & Pierce, PLC

(57) ABSTRACT

A projection portion (145) protruding from a bottom surface 8141*a*) on a core portion side towards the center of the core portion (130) is formed in a core plate (140). A bond portion (142*a*) between a tube (132) and the core plate (140) is arranged closer to the center side of the core portion (130) than the bottom surface (141*a*) and at substantially the same position in a tube longitudinal direction X with respect to a push surface (143*a*) of a packing (150). Therefore, even when a load in a direction intersecting at right angles the tube longitudinal direction is applied to a formation portion of a fitting groove portion (143), the occurrence of a bending moment can be suppressed.

6 Claims, 10 Drawing Sheets

HEAT EXCHANGER

BACKGROUND OF THE INVENTION

1. Field of the Invention

This invention relates to a heat exchanger. More particularly, the present invention can be suitably applied to a radiator for radiating heat, from the cooling water of a water-cooled engine, into the atmosphere.

2. Description of the Related Art

A known heat exchanger has a construction in which a tank made of a resin and core plate bonding tubes constituting a core portion are fixed to one another through a seal member such as a packing (Japanese Unexamined Utility Model Publication No. 61-141593).

FIG. 13 shows an example of a sectional construction of a tank portion of such a heat exchanger. As shown in FIG. 13, a core plate 140 is hermetically fixed to an open end face of a tank 110 through a packing 150 and constitutes a bottom surface 141*a* on the side of a core portion 130 inside a tank inner space.

A fitting groove portion 143 for fitting the packing 150 is formed in the core plate 140 on the outer periphery of a region forming the bottom surface 141*a* closer to the center of the core portion 130 (tube 132) than the bottom surface 141*a*. The packing 150 is fitted into the fitting groove 143 of the core plate 140 and is fixed by caulking to the tank 110 side.

The inner space of the tank portion formed by the tank 110 and the core plate 140 can be sufficiently secured by allowing the caulk-fixing portion with the packing 105 to protrude closer to the center of the core portion 130 than the bottom surface 141*a* of the core plate 140 even in the tank portion having a connection portion having seal performance.

In the heat exchanger according to the prior art described above, however, a load acts on the tank portion from multiple directions when vibration is applied to the heat exchanger, and stress occurs in the bond portion between the core plate and the tubes.

When a load H in a longitudinal direction of the tube 132 acts on the caulk-fixing portion as shown in FIG. 11, for example, a bending moment M occurs and stress concentrates on the tube bond portion (tube root portion). Because the caulk-fixing portion protrudes closer to the center of the core portion 130 than the bottom surface 141*a* of the core plate 140, the bending moment M occurs and stress also concentrates on the tube bond portion even when the load V in the direction intersecting at right angles the longitudinal direction of the tube 132 is applied.

When an attempt is made to reduce the thickness of the tube from the existing thickness, the tube is likely to be broken owing to the stress concentration at the bond portion between the tube and the core plate. In other words, a further decrease of the thickness of the tube has been difficult because life of the tube is likely to be reduced.

SUMMARY OF THE INVENTION

In view of the problems described above, the present invention is directed to provide a heat exchanger that can suppress the occurrence of the bending moment in the core plate and can mitigate the stress concentration on the tube bond portion.

To accomplish the object described above, a heat exchange according to one aspect of the invention includes a tank (110) formed of a resin; a core plate (140) hermetically fixed to an open end face of the tank (110) through a seal member (150); and a core portion (130) having an end portion thereof in a longitudinal direction (X) fitted and bonded into an insertion hole (142) of the core plate (140), and formed by stacking a plurality of tubes (132) communicating with the inside of the tank (110); the core plate (140) constituting a bottom surface (141*a*) of an internal space of the tank (110) on the side of the core portion (130); a push surface (143*a*) in the core plate (140) for pushing the seal member (150) towards the tank (110) being so shaped as to protrude towards the center of the core portion (130) with respect to the bottom surface (141*a*); wherein a projection portion (145) protruding from the bottom surface (141*a*) towards the center of the core portion (130) is formed in a formation region of the insertion hole (142) of the core plate (140), and a bond portion between the tubes (132) and the core plate (140) is arranged closer to the center of the core portion (130) than the bottom surface (141*a*).

According to this construction, the connection portion between the tank (110) protruding from the bottom surface (141*a*) towards the center of the core portion (130) and the bond portion (142*a*) between the tube (132) and the core plate (140) can be brought close to each other in the longitudinal direction (X) of the tube (132).

Therefore, even when a load is applied in a direction intersecting at right angles the longitudinal direction (X) of the tube (132), a bending moment occurs with difficulty in the core plate (140) and the stress concentration on the bond portion (142*a*) between the tube (132) and the core plate (140) can be suppressed.

In the invention, the bond portion between the tube (132) and the core plate (140) that is arranged closer to the center of the core portion (130) than the bottom surface (141*a*) is arranged at substantially the same position in the tube longitudinal direction (X) with respect to the push surface (143*a*) described above. When this construction is used, the occurrence of the bending moment due to a load in a direction intersecting, at right angles, the longitudinal direction (X) of the tube (132) can be suppressed and the stress concentration on the bond portion (142*a*) between the tube (132) and the core plate (140) can be reliably suppressed.

In the invention, the projection portion (145) of the core plate (140) has substantially a trapezoidal or arcuate shape on a section intersecting at right angles a stacking direction (Y) of the tubes (132).

According to this construction, the projection portion (145) can be easily formed by pressing, or the like.

In the invention, the tube (132) is a flat tube having a pair of straight portions (132*a*) opposing each other in a section intersecting at right angles the longitudinal direction (X), and a recess portion (146) is formed in the projection portion (145) at a portion corresponding to the center (A) of the straight portions (132*a*).

When a heat radiation member such as heat radiation fins are bonded to the outer surface of the flat tube of the heat exchanger, for example, the flat tube generally has a substantially oval sectional shape somewhat swelling out at its straight portions before it is inserted into an insertion hole of a core plate member.

According to the invention, therefore, when the flat tube (132) having the substantial oval sectional shape is fitted into the insertion hole (142), the insertion factor into the insertion hole (142) can be improved because the most protruding portion of the tube straight portion (132) (the uppermost portion in the direction of the minor axis of the oval shape) does not easily come into contact with the core plate portion (140) in the initial stage of insertion.

The heat exchanger according to the invention further includes side plate members (133) provided to the outermost portions of the core portion (130) in the stacking direction (Y) of a plurality of tubes (132) and having the ends thereof in the longitudinal direction bonded to the projection portion (145) of the core plate (140), wherein a projection height (H2) of the projection portion at the bond portion with the side plate members (133) is smaller than a projection height (H1) of the bond portion of the tubes (132).

When the projection height (H2) of the bond portion of the side plate member (133) and the projection height (H1) of the bond portion of the tube (132) are equal to each other, the angle of the slope of the projection portion (145) with respect to the bottom surface (141*a*) becomes large outside the bond portion of the side plate member (133) in the tube stacking direction (Y).

When the bond portion of the side plate member (133) is not provided to the projection portion (145), the angle of the slope of the projection portion (145) with respect to the bottom surface (141*a*) becomes large between the bond portion of the outermost tube (132) in the tube stacking direction (Y) and the bond portion of the side plate member (133).

In either case, it is relatively difficult to shape the projection portion (145) by press drawing.

When the projection height (H2) of the bond portion of the side plate member (133) of the projection portion (145) is smaller than the projection height (H1) of the bond portion of the tube (132) as in the present invention, that is, when the projection height (H2) of the bond portion of the side plate member (133) is set to an intermediate height between the projection height (H1) of the bond portion of the tube (132) and a portion that does not protrude (projection height=0), machining of the projection portion (145) is easy.

According to another aspect of the invention, there is provided a heat exchanger including a tank (110); a core plate (140) fixed to an open end face of the tank (110); and a core portion (130) having an end portion thereof in a longitudinal direction (X) fitted and bonded into an insertion hole (142) of the core plate (140), and formed by stacking a plurality of tubes (132) communicating with the inside of the tank (110); the core plate (140) constituting a bottom surface (141*a*) of an internal space of the tank (110) on the side of the core portion (130); a portion (143*b*) of the core plate (140) to which the open end face of the tank (110) is fixed being so shaped as to protrude towards the center of the core portion (130) with respect to the bottom surface (141*a*); wherein a projection portion (145) protruding from the bottom surface (141*a*) towards the center of the core portion (130) is formed in a formation region of the insertion hole (142) of the core plate (140), and a bond portion (142*a*) between the tubes (132) and the core plate (140) is arranged closer to the center of the core portion (130) than the bottom surface (141*a*).

According to the construction described above, the fixing portion between the tank (110) and the core plate (140) that protrudes from the bottom surface (141*a*) towards the center of the core portion (130) and the bond portion (142*a*) between the tube (132) and the core plate (140) can be brought close to each other in the longitudinal direction (X) of the tube (132).

Therefore, even when a load is applied in a direction intersecting at right angles the longitudinal direction (X) of the tube (132), a bending moment does not easily occur in the core plate (140) and the stress concentration on the bond portion between the tube (132) and the core plate (140) can be suppressed.

Incidentally, reference numerals inside parentheses assigned to each means exemplarily represent the correspondence relation with concrete means in the description of the later-appearing embodiments.

The present invention will be more fully understood from the following description of preferred embodiments taken in conjunction with the accompanying drawings.

DESCRIPTION OF THE PREFERRED EMBODIMENTS

Preferred embodiments of the invention will be hereinafter explained with reference to the accompanying drawings.

First Embodiment

Figure 1:
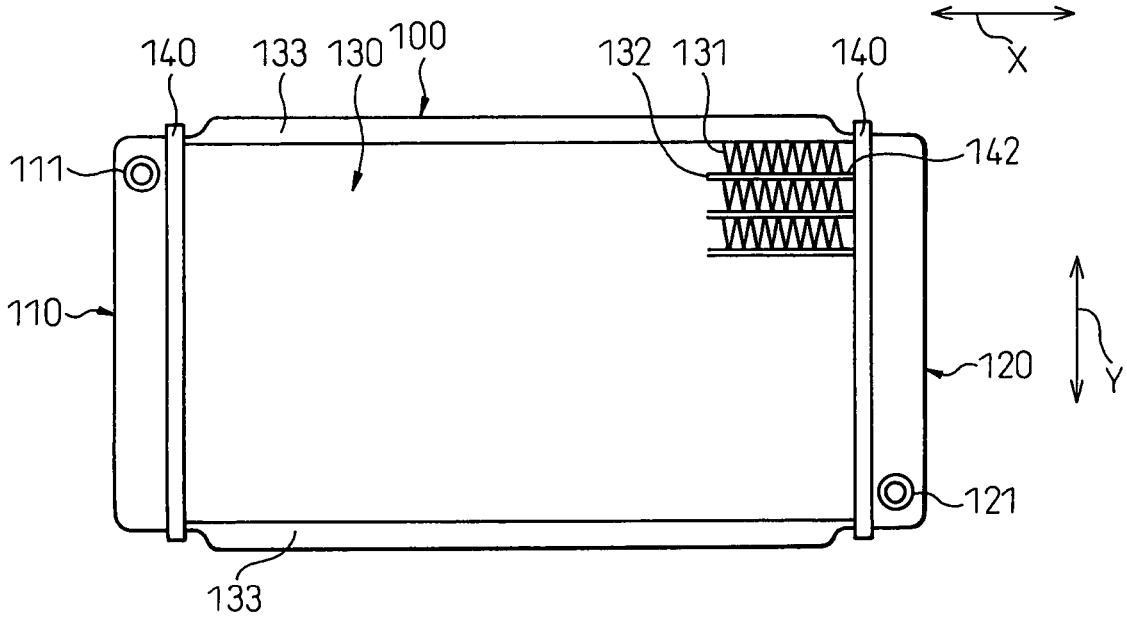
FIG. 1 is a front view showing a schematic construction of a radiator 100 as a heat exchanger according to a first embodiment of the invention.
Figure 2:
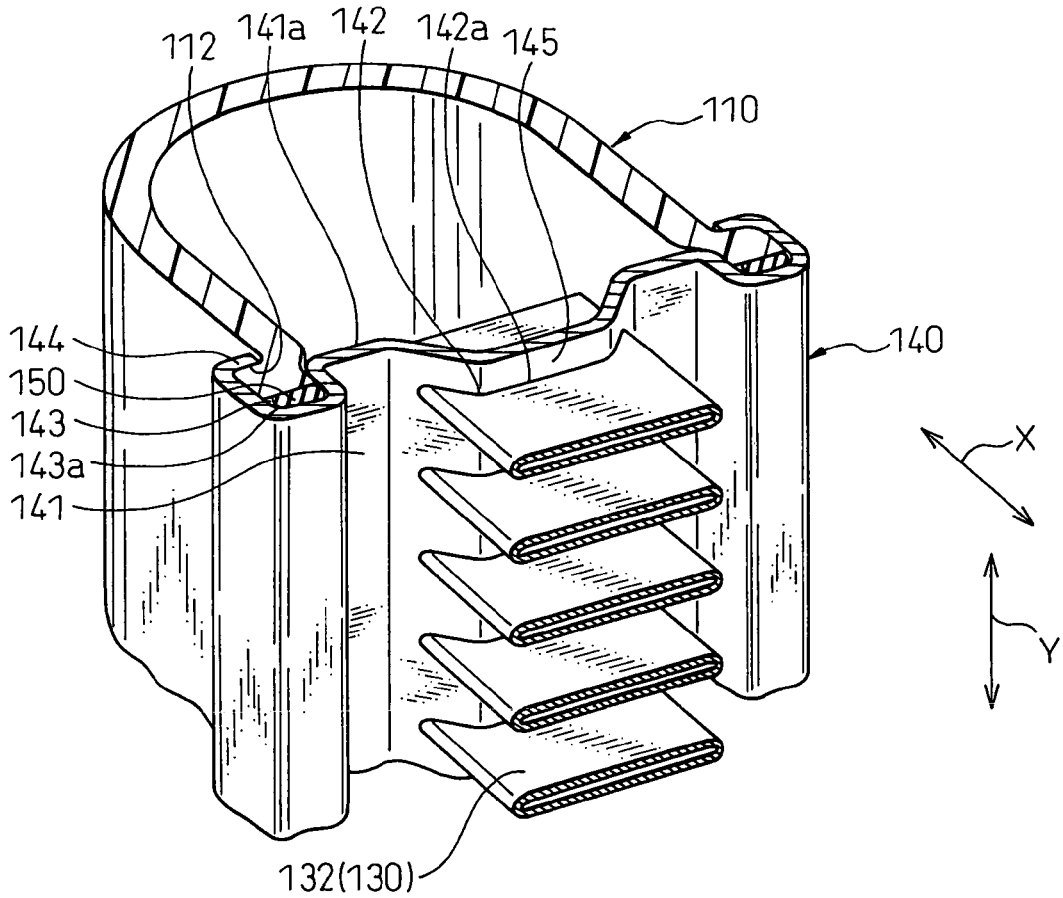
FIG. 2 is a perspective view of main portions showing a bond construction between a tank and a tube of the radiator 100.

FIG. 1 is a front view showing a schematic construction of a radiator 100 as a heat exchanger according to the first embodiment of the invention and FIG. 2 is a perspective view (partially in section) showing a bond construction between a tank and a tube in the radiator 100.

The radiator 100 shown in FIG. 1 is a radiator for a car that is mounted to a front part inside an engine compartment. The radiator 100 is of a so-called "cross flow type" in which cooling water flowing inside the tube 132 of a core portion 130 flows from the left to the right in the drawing. The radiator 100 basically includes the core portion 130, a left tank 110 and a right tank 120.

The core portion 130 is a heat exchanger portion directed to cool cooling water flowing therein and includes fins 131, tubes 132, side plates 133 and core plates 140. The fins 131 are formed by shaping a thin belt-like sheet into a corrugation form and slit-like louvers, not shown, are disposed therein.

The tube 132 is formed by bending a thin belt-like sheet, in such a fashion that its section becomes flat, and by welding end portions to one another. The fins 131 and the tubes 132 are alternately stacked in a vertical direction in FIG. 1 and the side plates 133 having a bracket sectional shape are further put to the uppermost and lowermost fins 131 from outside.

The core plate 140 is formed by drawing a flat sheet material and is so arranged as to extend in a stacking direction Y of the tubes 132. A plurality of insertion holes 142 as tube fitting portions is disposed at positions corresponding to the ends of the tubes 132 in a longitudinal direction X (hereinafter called "tube end portions"). The core portion 130 is formed when the end portions of the tubes 132 are fitted into the fitting holes 142.

Each member constituting the core portion 130 is formed of an aluminum alloy excellent in properties such as strength and corrosion resistance, and is integrally brazed to thereby form the core portion 130.

The left tank 110 is mechanically connected to the core plate 140 on the left side in the drawing by caulking and the right tank 120, to the core plate 140 on the right side in the drawing.

Both left and right tanks 110 and 120 are formed of a resin (polyamide resin in this embodiment).

An inlet pipe 111 is integrally formed with the left tank 110 and an output pipe 121 is formed integrally with the right tank 120. Because both left and right tanks 110 and 120 have substantially the same construction, the explanation of the main construction of this embodiment will be given by using the left tank 110.

The left tank 110 formed of the resin has a box-like container shape that has a substantially U-shaped sectional shape and an open portion on the side of the core plate 140 as shown in FIG. 2. The end portion of the left tank 110 on the opening side is fitted into a fitting groove (tank receiving groove) 143 which is formed at the outer peripheral portion of the core plate 140 and into which a packing 150 as a seal member is fitted. The left tank 110 is fixed by caulking as caulking pawls 144 are engaged with outside stepped surfaces 112 of the tank 110.

In other words, the tank 110 and the core plate 140 constitute a substantial tank in this embodiment. The end of the tube 132 is bonded to the core plate 140 as the core plate portion (side portion of the core portion 130) of this substantial tank and the inside of the tube 132 is communicated with the inner space of the tank.

A region more inside from the fitting groove portion 143 of the core plate 140 constitute the bottom surface 141 on the side of the core portion 130 of the substantial tank constituted by the tank 110 and the core plate 140. The bottom surface 141 is a reference surface of the core plate 140 and the surface of the bottom surface portion 141 on the side of the tank 110 is the bottom surface 141*a* of the tank inner space on the side of the core portion 130.

The fitting groove portion 143 is disposed on the outer periphery of this bottom surface 141*a*. Its push surface 143*a* that pushes a packing 150 towards the tank 110 with caulking is so formed as to protrude towards the center side of the core portion 130 with respect to the bottom surface 141*a*.

Figure 3:
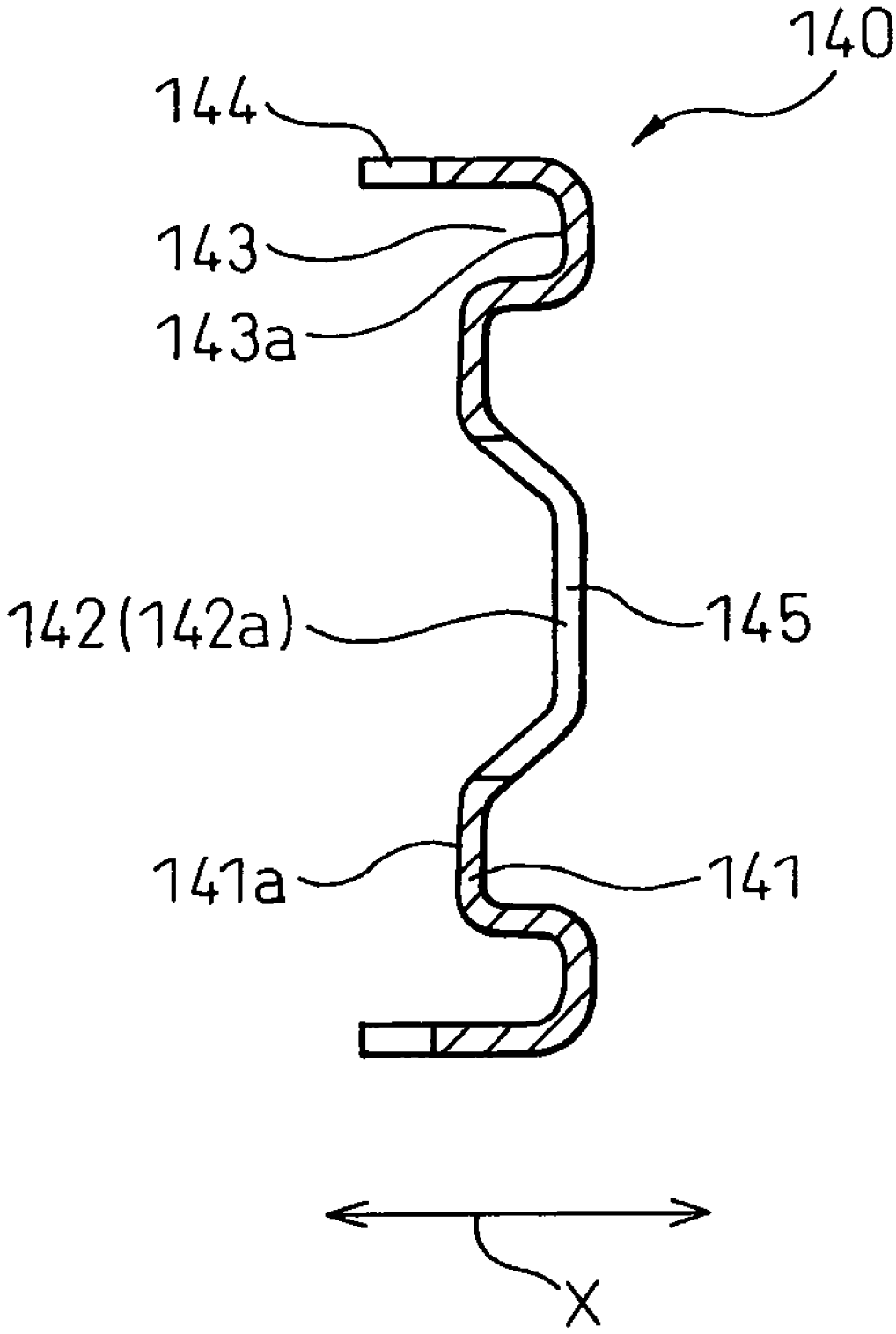
FIG. 3 is a sectional view in a direction intersecting at right angles a tube stacking direction of a core plate 140.

FIG. 3 is a sectional view intersecting at right angles the tube stacking direction (Y) of the core plate 140 and shows the section of the formation portion of the insertion hole 142. Incidentally, this sectional view shows only the core plate 140 before it is fixed to the tank 110 by caulking.

As shown in FIG. 3, a projection portion 145 that protrudes towards the outside of the tank (towards the center of core portion 130) and has substantially a trapezoidal sectional shape is formed in the core plate 140. The insertion hole 142 is fully formed inside the projection portion 145.

This projection portion 145 protrudes to substantially the same position as the push surface 143*a* of the fitting groove portion 143 in the tube longitudinal direction X. As can also be seen clearly from FIG. 2, the projection portion 145 is shaped in the core plate 140 in such a manner as to extend in the tube stacking direction Y.

Therefore, the bond portion 142*a* of the tube 132 of the core plate 140 protrudes to substantially the same length as the formation portion of the fitting groove portion 143 (caulk-fixing portion between tank and core plate) in the tube longitudinal direction X with respect to the bottom surface 141*a* as the reference surface as shown in FIG. 2.

According to the construction described above, the projection portion 145 protruding from the bottom surface 141*a* towards the center of the core portion 130 is formed in the core plate 140 and the insertion hole 142 is formed in this projection portion 145. Therefore, the bond portion 142*a* between the tube 132 and the core plate 140 is arranged closer to the center of the core portion 130 than the bottom surface 141*a*.

The bond portion 142*a* between the tube 132 arranged closer to the center of the core portion 130 than the bottom surface 141*a* and the core plate 140 is arranged at substantially the same position in the tube longitudinal direction X with respect to the push surface 143*a* of the packing 150.

Consequently, even when the load in the direction intersecting at right angles the longitudinal direction X of the tube 132 acts on the formation portion (caulk-fixing portion between tank and core plate) of the fitting groove portion 143 owing to vibration, it is possible to prevent the occurrence of the bending moment in the tube bond portion 142*a* of the core plate 140. As a result, it becomes possible to reliably suppress the stress concentration on the bond portion 142*a* between the tube 132 and the core plate 140.

Here, it is also possible to suppress the occurrence of the bonding moment in the tube bond portion 142*a* of the core plate 140 even when a projection portion is disposed between adjacent insertion holes 142 of the core plate 140 and the insertion holes 142 are formed at only the portions other then the projection portion.

In this embodiment, however, the insertion hole 142 of the core plate 140 is cubically formed in such a manner as to extend from the flat surface portion of the projection portion 145 to the slope portion as can be clearly seen from FIGS. 2 and 3, too. In other words, the bond portion between the tube 132 and the core plate 140 is cubically formed, too.

Therefore, the length of the bond portion between the tube 132 and the core plate 140 can be made greater than when the projection portion is not formed in the core plate 140 (when the insertion hole is formed inside one plane).

It thus becomes possible not only to suppress the occurrence of the bending moment but also to disperse the stress occurring in the tube 132 at the bond portion between the tube 132 and the core plate 140 and eventually to increase the life of the tube 132.

The stress concentration on a part of the tube 143 can be more easily mitigated by supporting cubically the tube 132 at the bond portion with the core pate 140 even when the stress is applied in the direction in which the tube 132 is tilted with respect to the bottom surface 141 of the core plate 140.

As described above, the bond portion construction between the tube 132 and the core plate 140 in this embodiment can exhibit the stress dispersion effect not only for the stress resulting from the vibration but also for the application of the heat stress.

The projection portion 145 formed on the core plate 140 has a substantially trapezoidal sectional shape in the direction intersecting at right angles the tube stacking direction Y and can be easily formed by pressing the projection portion 145, for example.

Figure 4A:
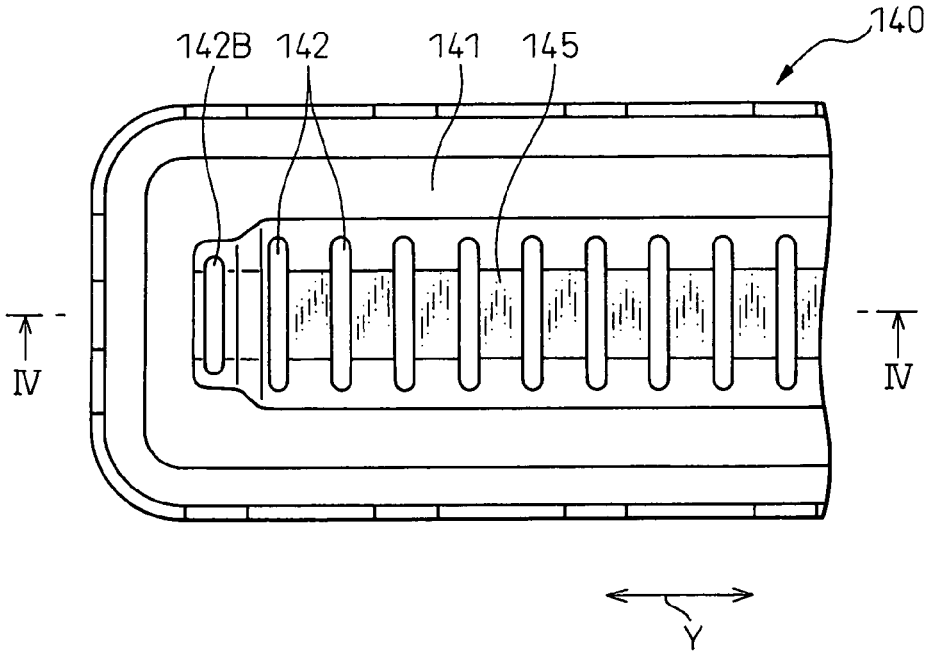
FIG. 4A is a plan view of main portions of the core plate 140 and FIG. 4B is a sectional view taken along a line IV-IV of FIG. 4A.
Figure 4B:
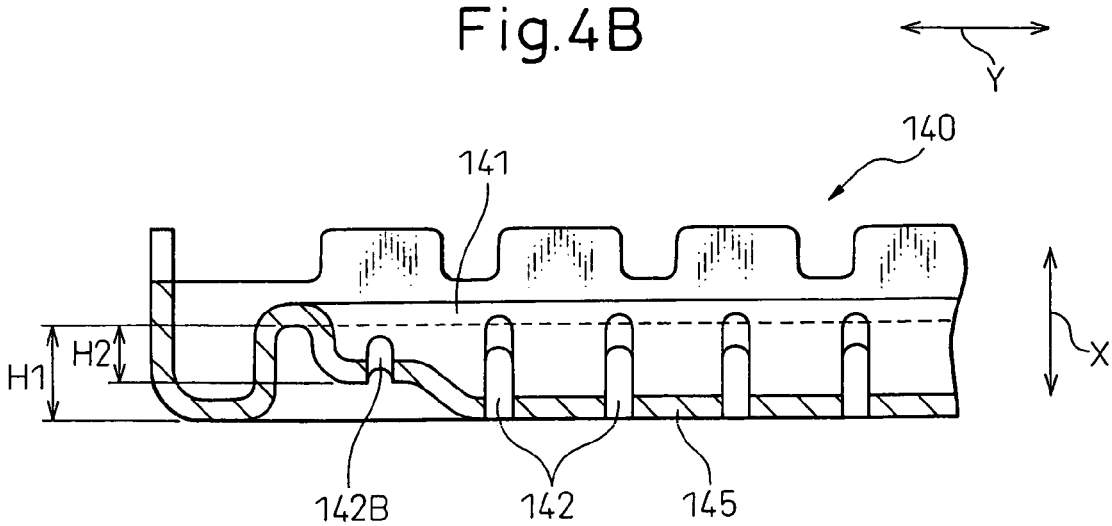

The core plate 140 has an insertion hole 142B for inserting and bonding the end portion of the side plate 133 disposed at the outermost portion of the core portion 130 in the tube stacking direction, as shown in FIGS. 4A and 4B, though it is omitted from the explanation of the construction described above.

Here, FIG. 4A is a plan view of main portions of the core plate 140 as the single substance and FIG. 4B is a sectional view taken along a line IV-IV of FIG. 4A.

As shown in FIGS. 4A and 4B, the projection portion 145 extending in the longitudinal direction of the core plate (in the tube stacking direction Y) has a small projection height from the formation portion of the insertion hole 142 of the core portion 130 for inserting the outermost tube 132 to the left in the drawings.

The projection height H2 of the bond portion of the side plate 133 is smaller than the projection height H1 of the bond portion of the tube 132. In other words, the projection height H2 of the insertion hole (142B) formation portion of the side plate 133 is an intermediate height between the projection height H1 of the insertion hole (142) formation portion of the tube 132 and the bottom surface portion 141 not having the projection portion.

When the projection height H2 of the insertion hole (142B) formation portion of the side plate 133 is set to be equal to the projection height H1 of the insertion hole (142) formation portion of the tube 132, the projection portion 145 must be acutely inclined outside the insertion hole 142B of the side plate 133 (on the left side in the drawings) in the tube stacking direction Y.

When the insertion hole 142B of the side plate 133 is formed in the bottom surface portion 141, the projection portion 145 must be acutely inclined between the insertion hole (142) formation portion of the outermost tube 132 in the tube stacking direction Y and the insertion hole (142B) formation portion of the side plate 133. In either case, it is relatively difficult to form the projection portion 145 by drawing.

When the projection height H2 of the insertion hole (142B) formation portion of the side plate 133 (side plate bond portion) is smaller than the projection height H1 of the insertion hole (142) formation potion of the tube 132 (tube bond portion) as in this embodiment, that is, when the projection height H2 of the bond portion of the side plate member 133 is set to the intermediate height between the projection height H1 of the bond portion of the tube 132 and the bottom surface portion 141 (having a projection height of 0) that does not protrude, machining for forming the projection portion 145 is easy.

Second Embodiment

Next, the second embodiment of the invention will be explained with reference to FIGS. 5, 6A and 6B.

The second embodiment employs the construction that improves the insertion property of the tube end portion into the insertion hole in comparison with the first embodiment described above.

Incidentally, like reference numerals are used to identify like constituent members in the first embodiment and the explanation of such members will be omitted.

Figure 5:
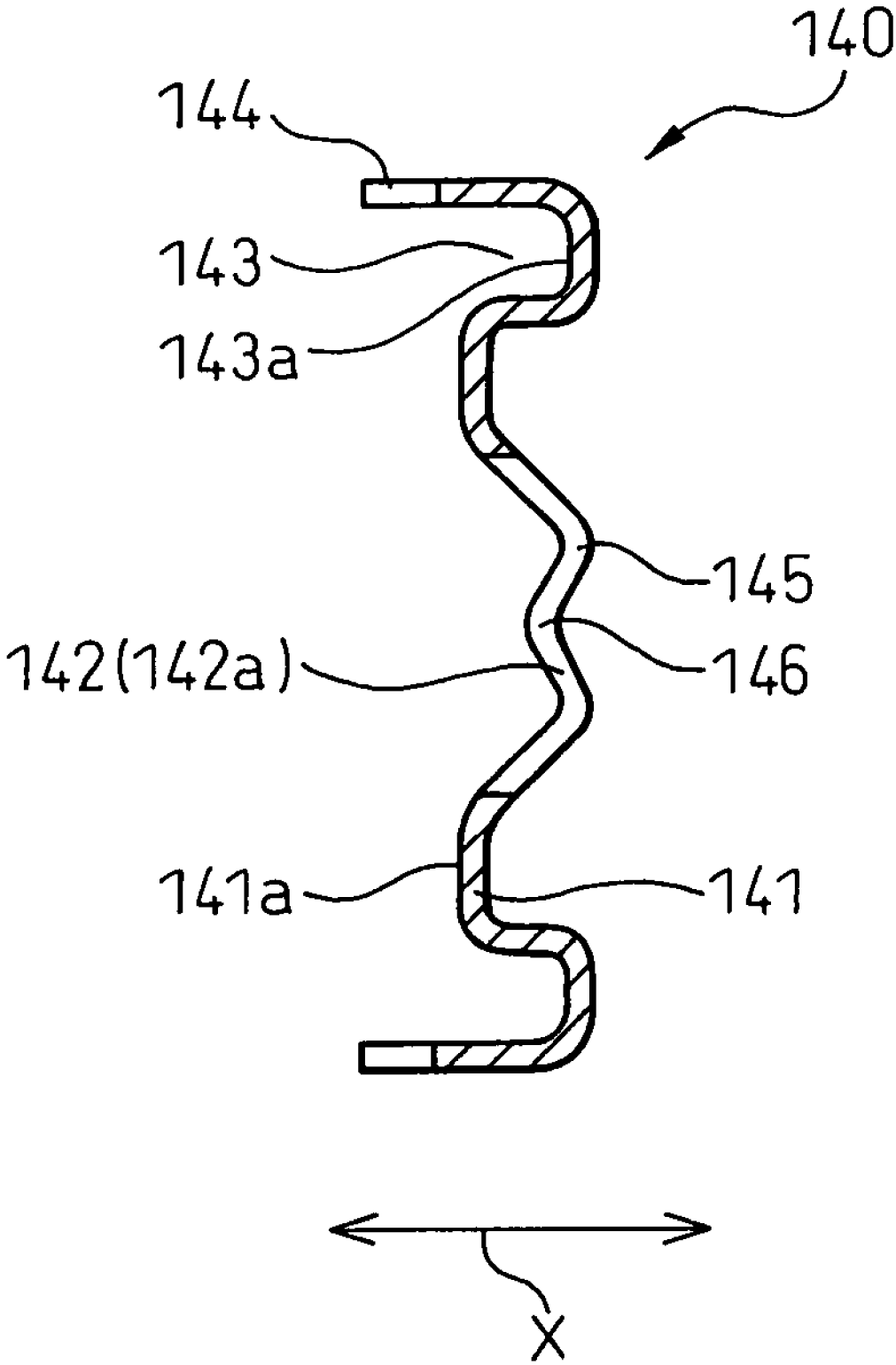
FIG. 5 is a sectional view intersecting at right angles a tube stacking direction of a core plate 140 in the second embodiment.

In this embodiment, a recess portion 146 recessed towards the tank inside is formed at the center of the projection portion 145 having the substantial trapezoidal sectional shape that is formed on the core plate 140, in the vertical direction in the drawing as shown in FIG. 5.

Figure 6A:
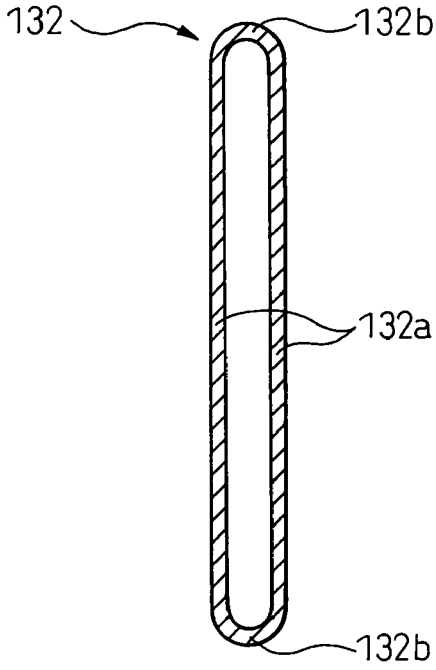
FIG. 6A is a sectional view intersecting at right angles a longitudinal direction of a tube 132 and FIG. 6B is a sectional view of the tube 132 before it is inserted into an insertion hole 142 of the core plate 140.

The tube 132 to be inserted and bonded to the insertion hole 142 of this core plate 140 is a flat tube and includes a pair of straight portions 132*a* opposing each other and a pair of rounded portions (wall surface portions) 132*b* connecting the end portions of the pair of straight portions 132*a* as the sectional shape intersecting at right angles the tube longitudinal direction X is shown in FIG. 6A.

In other words, the recess portion 146 formed on the core plate 140 is formed at the position corresponding to the center of the tube straight portion 132*a* of the projection portion 145 of the core plate portion 140.

Figure 6B:
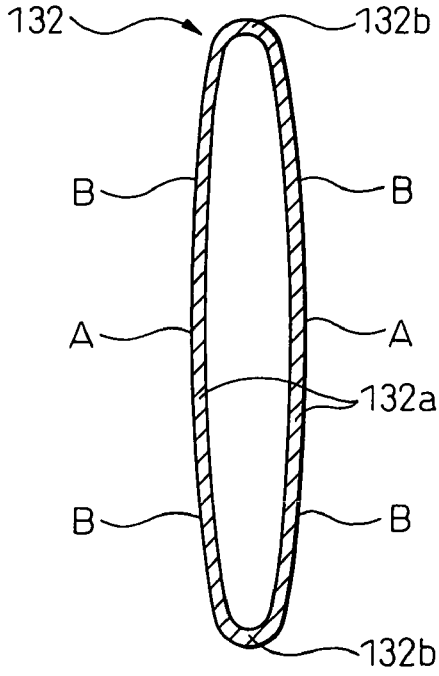

To improve adhesion of the fins 131 to the outer surface of the straight portion 132*a*, the tube 132 has a substantially oval sectional shape the straight portions 142*a* of which somewhat swell outward and the center A point of which extends most outward before the tube 132 is fitted into the insertion hole 142 of the core plate 140 as its schematic sectional shape is illustrated in FIG. 6B.

According to this embodiment, therefore, when the flat tube 132 having the substantially oval sectional shape is inserted into the insertion hole 142, the most protrusive (outermost in the minor direction of the oval shape) A point of the tube straight portion 132*a* does not touch the core plate portion 140 in the initial stage of insertion, but a B point having a smaller width in the minor axis direction than the A point does touch.

When the insertion of the tube 132 into the insertion hole 142 is continued after the B point comes into contact with the core plate 140, the straight portion 132*a* is pushed inward with the insertion of the B point, the width in the minor axis direction at the A point becomes smaller and the insertion of the tube 132 into the insertion hole 142 becomes easier. It is thus possible to improve the insertion property of the flat tube 132 having the substantially oval sectional shape into the insertion hole 142.

Other Embodiments

In each of the embodiments described above, the sectional shape of the projection portion 145 of the core plate 140 in the direction intersecting at right angles the tube stacking direction Y is substantially trapezoidal but the shape of the projection portion is not limited to this shape.

Figure 7:
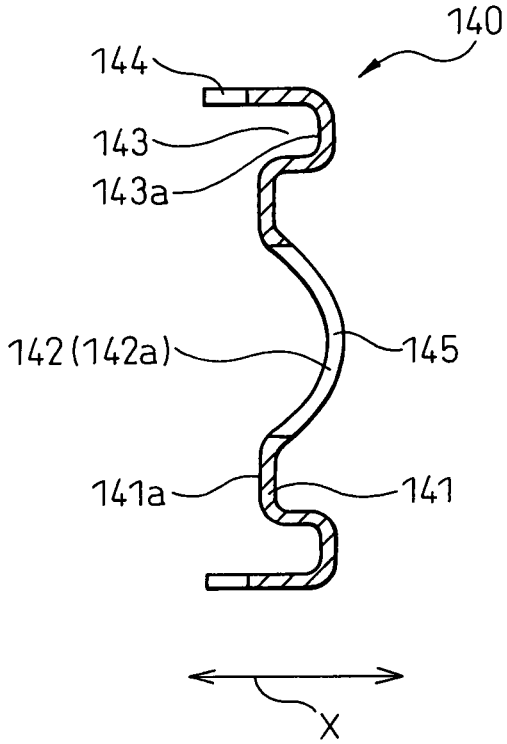
FIG. 7 is a sectional view of a core plate in another embodiment of the invention.

For example, the sectional shape of the projection portion 145 in the direction intersecting at right angles the tube stacking direction Y may be substantially arcuate as shown in the sectional view of the core plate in FIG. 7.

In the second embodiment described above, the recess portion 146 is formed in the projection portion 145 having the substantially trapezoidal sectional shape but the recess portion may be formed in projection portions having other shapes.

In each of the embodiments described above, the tube insertion hole 142 of the core plate 140 is formed fully inside the projection portion 145 but at least a part of the insertion hole 142 may be formed in the projection portion.

Figure 8:
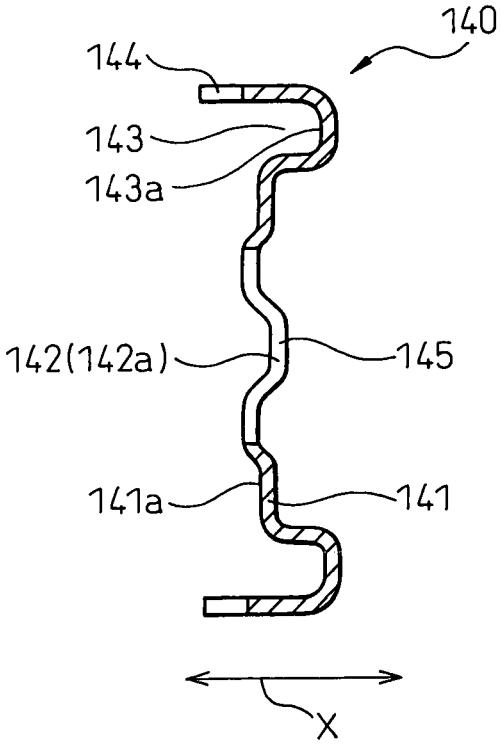
FIG. 8 is a sectional view of a core plate in still another embodiment of the invention.
Figure 9:
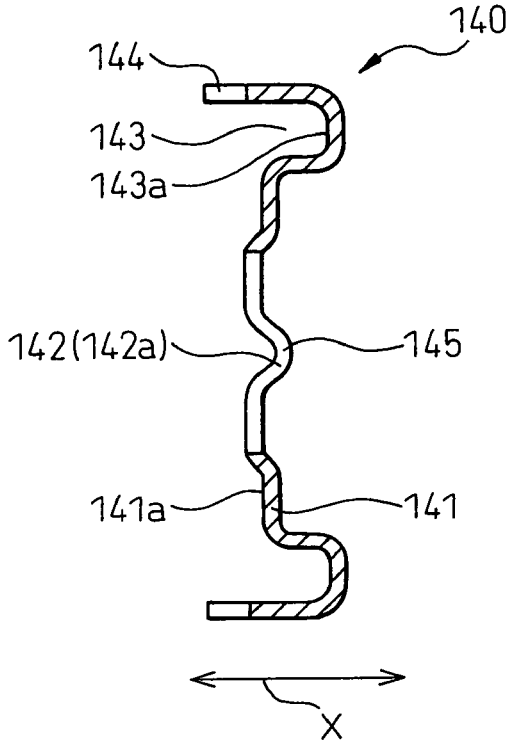
FIG. 9 is a sectional view of a core plate in still another embodiment of the invention.
Figure 10:
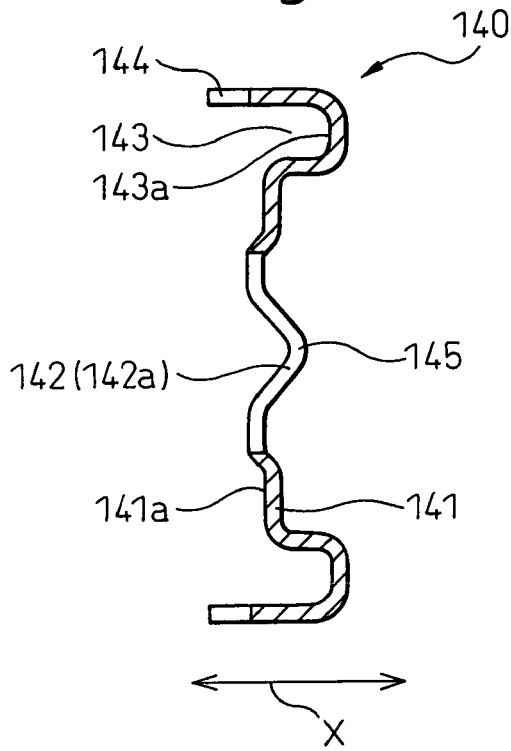
FIG. 10 is a sectional view of a core plate in still another embodiment of the invention.

For example, as shown in FIGS. 8 to 10, a projection portion 145 having substantially a trapezoidal, arcuate or triangular shape (substantially arcuate shape formed by elongating a slope) may be formed at a portion corresponding to the straight portion of the tube 132.

When any of these shapes is used, the tube bond portion 142*a* is allowed to protrude towards the center of the core portion 130 by the projection portion 145 and the occurrence of the bending moment at this projecting bond portion 142*a* can be suppressed. The effect of dispersing the stress can be acquired, too, by cubically forming the tube bond portion and increasing the length of the bond portion between the tube 132 and the core plate 140. As the portion of the tube insertion hole 142 corresponding to the tube rounded portion 132*b* is formed on the planar bottom surface portion 141, the end portion of the tube 132 can be easily inserted.

Figure 11:
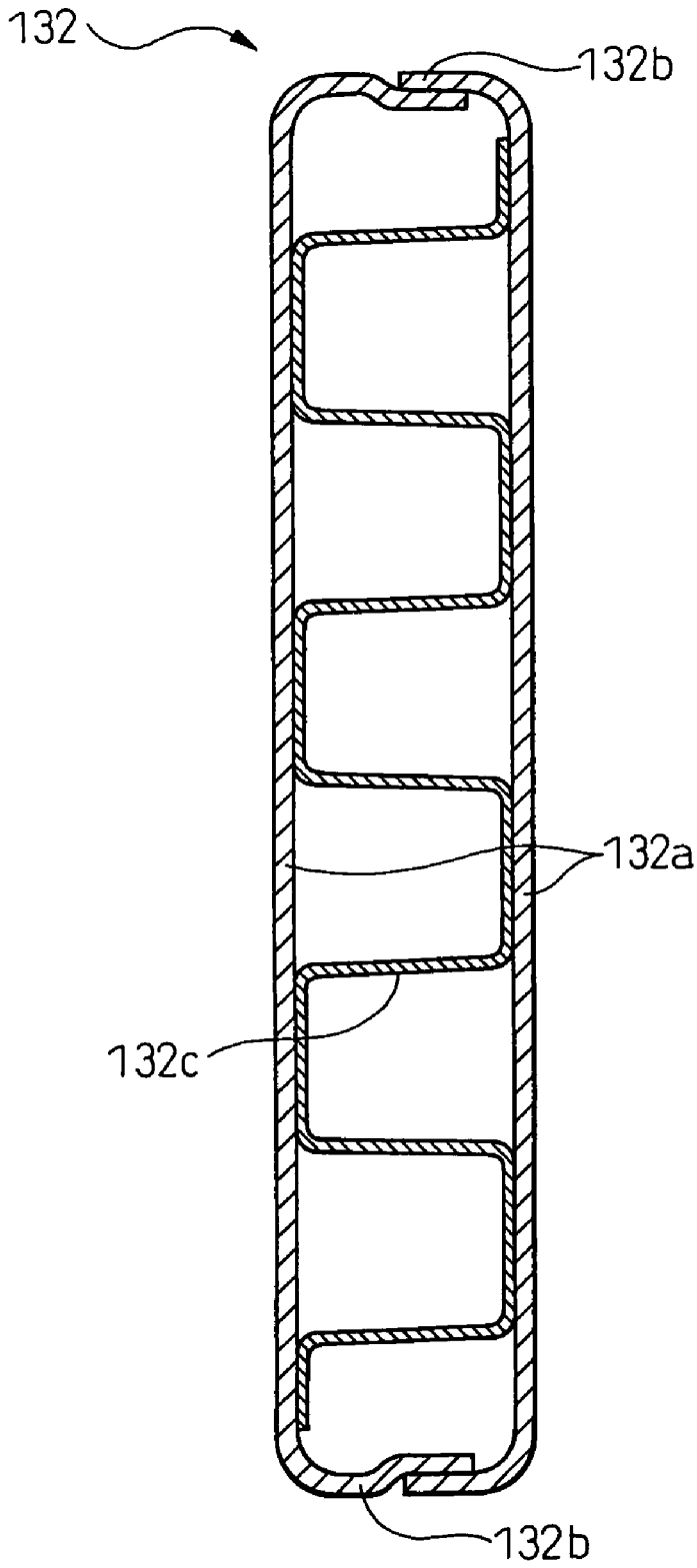
FIG. 11 is a sectional view of a tube in another embodiment of the invention.

In each of the embodiments described above, the sectional shape of the tube 132 the end portions of which are bonded to the core plate 140 includes a pair of straight portions 132*a* and a pair of rounded portions 132*b* connecting the end portions of the straight portions 132*a* to each other, but the tube shape is not limited thereto. For example, the invention can also be applied to a tube 132 having inner fins 132*c* therein and a rectangular sectional shape whose sectional shape in the direction intersecting at right angles the longitudinal direction is formed by combining and bonding plate members having, substantially, bracket shapes and including a pair of straight portions 132*a* and a pair of wall surface portions 132*b* connecting the ends of the pair of straight portions as its sectional shape is shown in FIG. 11.

In each of the embodiments described above, the invention is applied to the radiator 100 having resin tanks 110 and 120. However, the invention can also be applied to a radiator 200 having a tank 110 and a core plate 140 each of which is formed of a metal sheet material (such as an aluminum alloy) as its main portions are shown in FIG. 12, for example.

Figure 12:
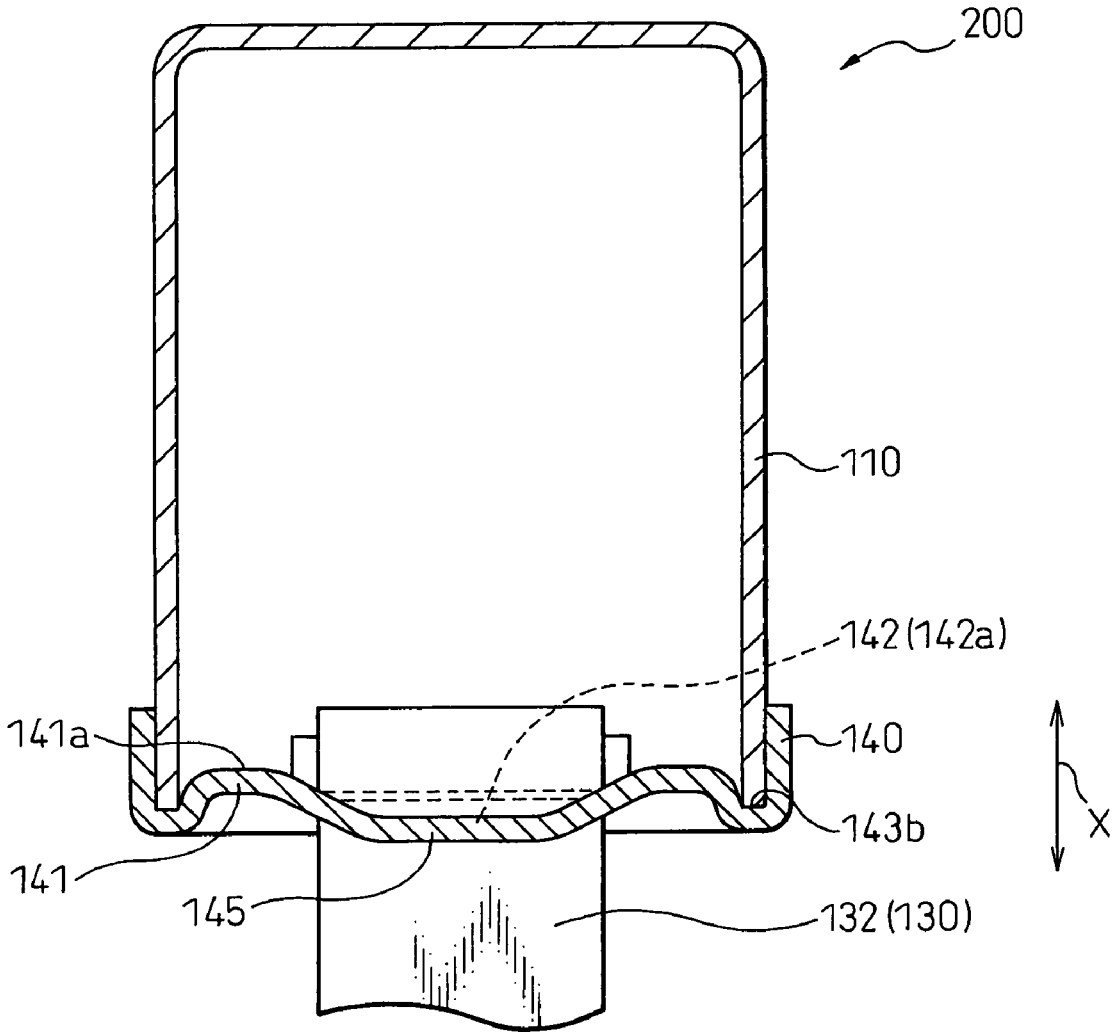
FIG. 12 is a sectional view of main portions in still another embodiment of the invention.
Figure 13:
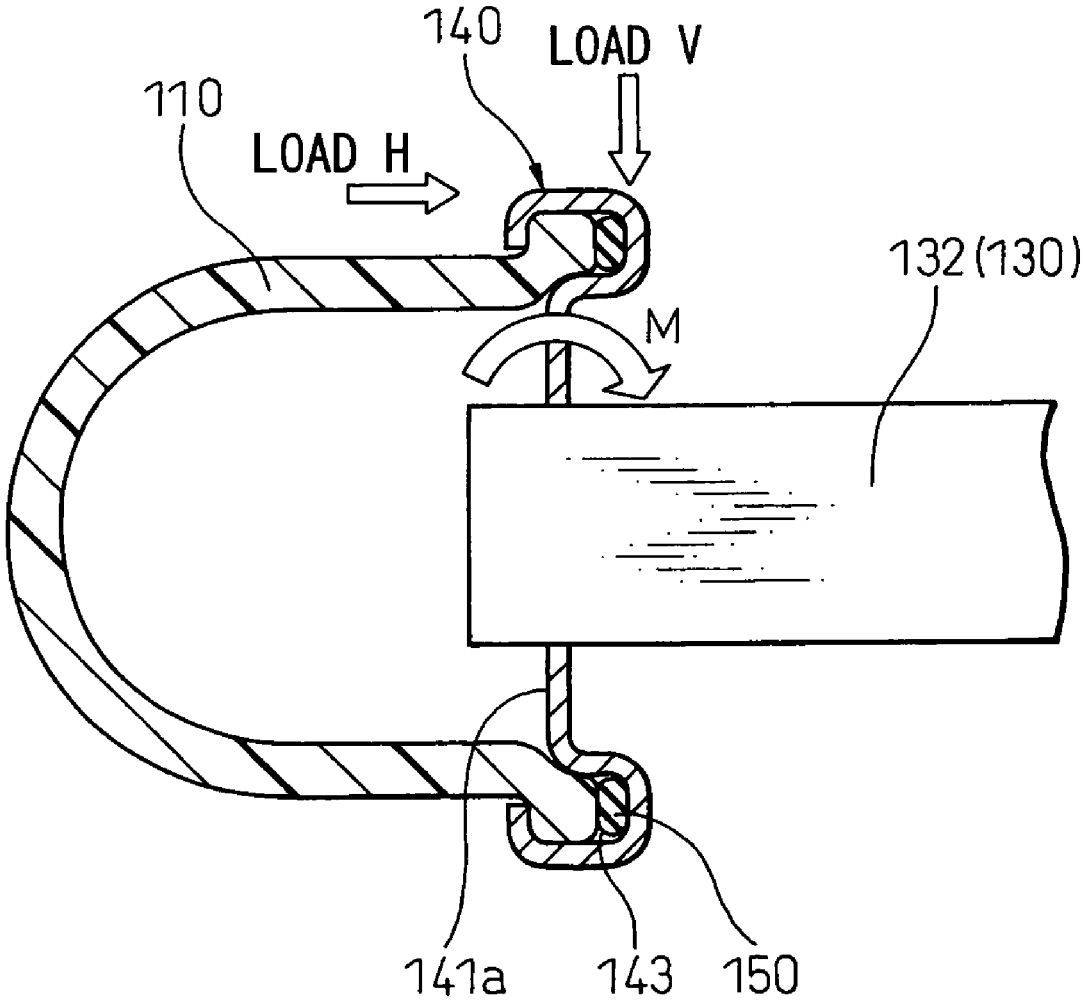
FIG. 13 is a sectional view of main portions in a heat exchanger according to the prior art.

In the radiator (heat exchanger) 200 having a construction in which a portion (bond portion) 143*b* of the core plate 140 to which the open end face of the tank 110 is to be fixed is formed in such a manner as to protrude towards the center of the core portion 130 with respect to the bottom surface 141*a* of the core plate 140 as shown in FIG. 12, it is possible to employ the construction in which the projection portion 145 protruding from the bottom surface 141*a* towards the center of the core portion 130 is formed in the formation region of the insertion hole 142 of the core plate 140 and the bond portion 142*a* between the tube 132 and the core plate 140 is arranged closer to the center of the core portion 130 than the bottom surface 141*a* of the core plate 140.

According to this construction, too, the fixing portion of the tank 110 protruding from the bottom surface 141*a* of the core plate 140 towards the center of the core portion 130 and the core plate 140 and the bond portion 142*a* between the tube 132 and the core plate 140 can be set to substantially the same position in the longitudinal direction X of the tube 132.

Therefore, even when the load in the direction intersecting at right angles the longitudinal direction X of the tube 132 acts on the tank fixing portion 143*b* due to vibration, it is possible to suppress the occurrence of the bending moment in the tube bond portion 142*a* of the core plate 140. Consequently, the stress concentration on the bond portion 142*a* between the tube 132 and the core plate 140 can be suppressed.

In each of the embodiments described above, the radiator 100 is of the so-called "cross flow type" but it may be of a so-called "vertical flow type" in which cooling water flows from above to below. When the radiator is mounted to the car, however, vibration in the vertical direction of the car, intersecting at right angles the tube longitudinal direction, is more likely to act on the radiator in the case of the cross flow type. Therefore, the effect brought forth by applying the invention is greater. Generally, the cross flow type has a larger tube length and thermal stress is therefore more likely to occur. For this reason, the effect of the invention is large.

In each of the embodiments described above, the invention is applied to the radiator. However, the invention can also be applied to heat exchangers other than the radiator such as an inter-cooler, an oil cooler, an EGR gas cooler, and so forth.

Although the invention has been described in detail about its specific embodiments, various changes and modifications can be made thereto, by those skilled in the art, without departing from the scope of claim and the spirit of the invention.

The invention claimed is:

1. A heat exchanger comprising:

a tank formed of a resin;

a core plate hermetically fixed to an open end face of said tank through a seal member; and a core portion having an end portion thereof in a longitudinal direction (X) fitted and bonded into an insertion hole of said core plate, and formed by stacking a plurality of tubes communicating with the inside of said tank;

said core plate constituting a bottom surface of an internal space of said tank on the side of said core portion;

a push surface in said core plate for pushing said seal member towards said tank being so shaped as to protrude towards the center of said core portion with respect to said bottom surface;

wherein:

a projection portion protruding from said bottom surface towards the center of said core portion is formed in a formation region of said insertion hole of said core plate, and a bond portion between said tubes and said core plate is arranged closer to the center of said core portion than to said bottom surface.

2. A heat exchanger according to claim 1, wherein said bond portion arranged closer to the center of said core portion than said bottom surface is arranged at substantially the same position in said longitudinal direction (X) with respect to said push surface.

3. A heat exchanger according to claim 1, wherein said projection portion has substantially a trapezoidal or arcuate shape on a section intersecting at right angles a stacking direction (Y) of said tubes.

4. A heat exchanger according to claim 1, wherein said tube is a flat tube having a pair of straight portions opposing each other in a section intersecting at right angles said longitudinal direction (X), and a recess portion is formed in said projection portion at a portion corresponding to the center (A) of said straight portion.

5. A heat exchanger according to claim 1, which further comprises side plate members provided to the outermost portions of said core portion in the stacking direction (Y) of said plurality of tubes and having the ends thereof in the longitudinal direction bonded to said projection portion, and wherein a projection height (H2) of said projection portion at the bond portion with said side plate members is smaller than a projection height (H1) of said bond portions of said tubes.

6. A heat exchanger comprising:

a tank;

a core plate fixed to an open end face of said tank; and a core portion having an end portion thereof in a longitudinal direction (X) fitted and bonded into an insertion hole of said core plate, and formed by stacking a plurality of tubes communicating with the inside of said tank;

said core plate constituting a bottom surface of an internal space of said tank on the side of said core portion;

a portion of said core plate to which the open end face of said tank is fixed being so shaped as to protrude towards the center of said core portion with respect to said bottom surface;

wherein:

a projection portion protruding from said bottom surface towards the center of said core portion is formed in a formation region of said insertion hole of said core plate, and a bond portion between said tubes and said core plate is arranged closer to the center of said core portion than said bottom surface.

* * * * *